US009313586B2

(12) United States Patent
Ubezio et al.

(10) Patent No.: US 9,313,586 B2
(45) Date of Patent: Apr. 12, 2016

(54) DEACTIVATABLE HEARING DEVICE, CORRESPONDING HEARING SYSTEM AND METHOD FOR OPERATING A HEARING SYSTEM

(75) Inventors: Marcel Ubezio, HW Malden (NL); Christian Reus, Schmerikon (CH); Hans-Ueli Roeck, Hombrechtikon (CH); Ruedi Suter, Binz (CH); Pete Jones, Uetikon am See (CH)

(73) Assignee: SONOVA AG, Staefa (CH)

( * ) Notice: Subject to any disclaimer, the term of this patent is extended or adjusted under 35 U.S.C. 154(b) by 923 days.

(21) Appl. No.: 13/384,647

(22) PCT Filed: Jul. 21, 2009

(86) PCT No.: PCT/EP2009/059385

§ 371 (c)(1),
(2), (4) Date: Feb. 21, 2012

(87) PCT Pub. No.: WO2009/127745

PCT Pub. Date: Oct. 22, 2009

(65) Prior Publication Data

US 2012/0140962 A1 Jun. 7, 2012

(51) Int. Cl.
*H04R 25/00* (2006.01)

(52) U.S. Cl.
CPC ..... *H04R 25/558* (2013.01); *H04R 25/70* (2013.01); *H04R 2225/55* (2013.01); *H04R 2225/61* (2013.01)

(58) Field of Classification Search
CPC ..... H04R 2225/61; H04R 2225/39; H04R 25/30; H04R 2225/55; H04R 25/558; H04R 25/70
USPC ..... 381/314, 312, 60
See application file for complete search history.

(56) References Cited

U.S. PATENT DOCUMENTS 7,729,501 B2 * 6/2010 Hasler ..... H04R 25/30 381/312
2006/0227987 A1 10/2006 Hasler

FOREIGN PATENT DOCUMENTS

EP 2071875 A2 6/2009
EP 2439963 A2 * 4/2012 ..... H04R 25/70
WO 2006/136616 A2 12/2006
WO 2007/098605 A1 9/2007
WO 2008/119382 A1 10/2008

OTHER PUBLICATIONS

International Search Report for PCT/EP2009/059385 dated Mar. 3, 2010.
Written Opinion for PCT/EP2009/059385 dated Mar. 3, 2010.

* cited by examiner

*Primary Examiner* — Davetta W Goins
*Assistant Examiner* — Phylesha Dabney
(74) *Attorney, Agent, or Firm* — Pearne & Gordon LLP

(57) ABSTRACT

The hearing system (1) comprises at least one hearing device which comprises an operability control unit (3) and, operationally connectable thereto, a storage unit (4) in which operability data (5) are stored. The operability control unit (3) is structured and configured to either disable or not disable the hearing device (2) from functioning as a hearing device in dependence of the operability data (5), and the hearing system comprises no means for modifying the operability data (5), more particularly comprises no means for modifying the operability data stored in the storage unit (4). The method for operating a hearing system (1) comprises providing a hearing system (1) comprising at least one hearing device (2) comprising an operability control unit (3) and, operationally connected thereto a storage unit (4) in which operability data (5) are stored, wherein the hearing system comprises no means for modifying the operability data. In dependence of the operability data (5), the method comprises either disabling the hearing device (2) by means of the operability control unit (3) from functioning as a hearing device, or not doing so.

24 Claims, 1 Drawing Sheet

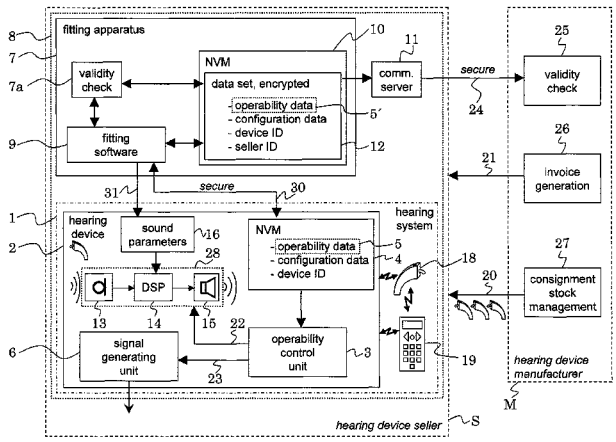

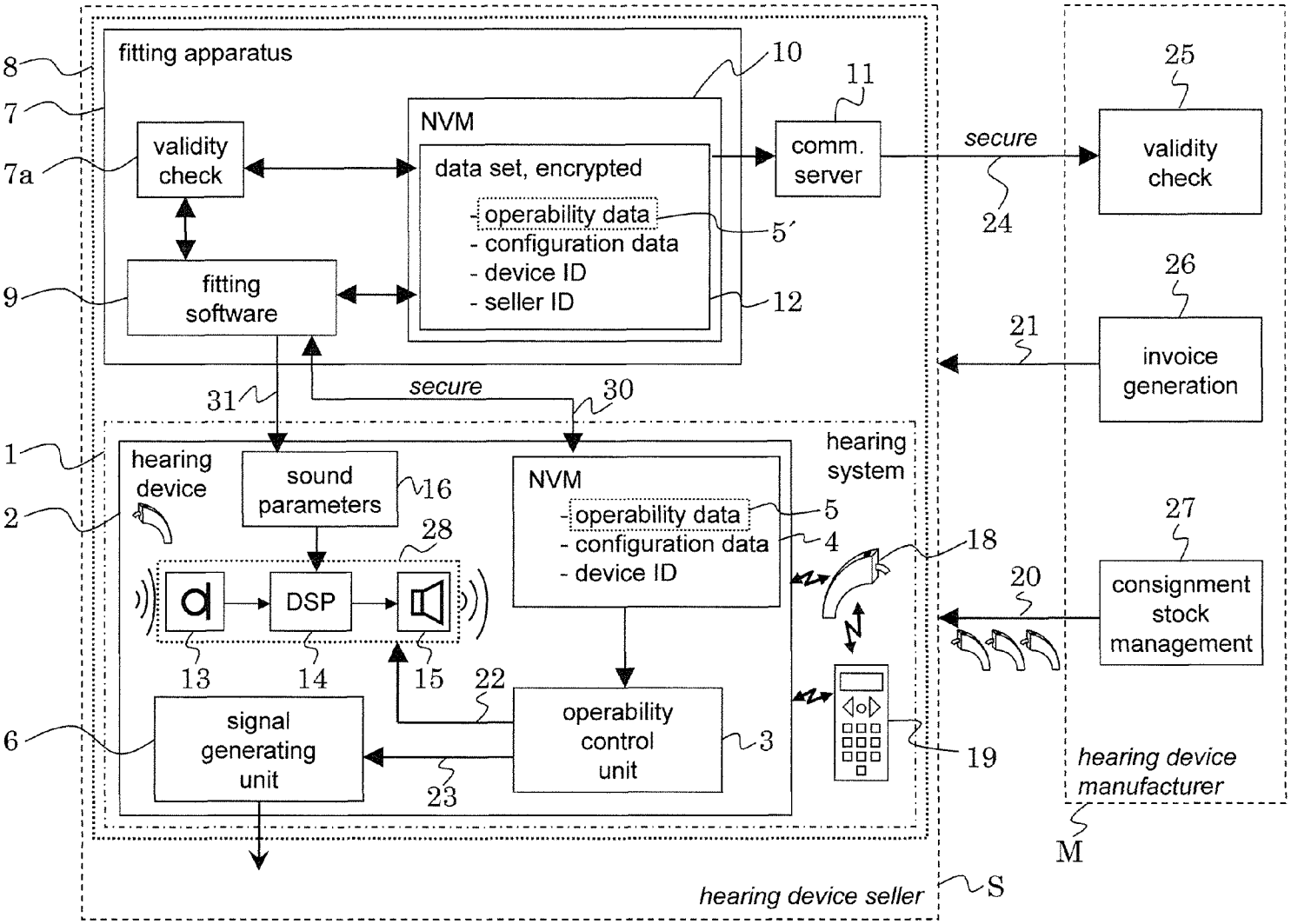
validity check
invoice generation
consignment stock management
hearing device manufacturer
M
25
26
27
secure
24
21
20
18
19
S
hearing device seller
comm. server
11
10
5'
12
NVM
data set, encrypted
- operability data
- configuration data
- device ID
- seller ID
fitting apparatus
validity check
fitting software
8
7
7a
9
30
secure
31
hearing system
5
4
NVM
- operability data
- configuration data
- device ID
3
operability control unit
22
23
16
28
15
sound parameters
DSP
14
13
signal generating unit
hearing device
1
2
6

DEACTIVATABLE HEARING DEVICE, CORRESPONDING HEARING SYSTEM AND METHOD FOR OPERATING A HEARING SYSTEM

TECHNICAL FIELD

The invention relates to the field of hearing devices and hearing systems. It relates to methods and apparatuses according to the opening clauses of the claims.

Under a hearing device, a device is understood, which is worn in or adjacent to an individual's ear with the object to improve the individual's audiological perception. Such improvement may also be barring acoustic signals from being perceived in the sense of hearing protection for the individual. If the hearing device is tailored so as to improve the perception of a hearing impaired individual towards hearing perception of a normal-hearing individual, then we speak of a hearing-aid device. With respect to the application area, a hearing device may be applied, e.g., behind the ear, in the ear, completely in the ear canal or may be implanted.

A hearing system comprises at least one hearing device. In case that a hearing system comprises at least one additional device, all devices of the hearing system are operationally connectable within the hearing system.

Typically, said additional devices such as another hearing device, a remote control or a remote microphone, are meant to be worn or carried by said individual.

Under audio signals we understand electrical signals, analogue and/or digital, which represent sound.

BACKGROUND OF THE INVENTION

DE 199 49 604 A1 describes a method according to which a hearing aid is delivered to a dealer in a basic version, wherein it is possible to functionally upgrade the hearing aid using a chip card. An integrated circuit of the hearing aid is, accordingly, provided initially programmed so as to provide only basic functionalities, and then, said integrated circuit is programmed, so as to provide additional functionalities.

US 2002/0054689 A1 describes a method for upgrading a hearing device. The upgrading process requires an online connection to a remote server.

WO 2006/002035 A2 describes a low-cost, time limited hearing health aid, which is intended for temporary, evaluative purposes. The hearing health aid comprises a counter, and after a predetermined count is reached by the counter, operations of the hearing health aid will be disabled.

SUMMARY OF THE INVENTION

The inventors have found that it can be advantageous to provide a new possibility to enable and disable a hearing device from functioning as a hearing device, e.g., in such a way, that carrying out a corresponding enabling process in which a deactivation of a hearing device is cancelled has to meet considerable prerequisites, in particular from an authorization point of view, and furthermore, it shall in particular be possible that such an enabling process is very safe, in particular from a technical and/or security point of view.

This can be advantageous, e.g., for simplifying hearing device logistics. Administrative efforts in conjunction with, e.g., the shipping of hearing devices, the billing of hearing device sellers or fitters by a hearing device manufacturer or distributor, the handling of warranty cases, the handling of returns, the handling of repair cases, the introduction of new hearing device models can be reduced or minimized and/or these processes can be particularly safe and/or well-controlled.

It is, e.g., possible to provide hearing device sellers with a consignment stock of hearing device, and the replenishment of the consignment stock is a robust process, and in particular a process which can be readily controlled by the hearing device manufacturer.

One object of the invention is to create a new kind of hearing system, a new kind of hearing system fitting system, a corresponding new method for operating a hearing system and a new method for handling hearing systems.

Another object of the invention is to provide a hearing system, a hearing system fitting system, a method for operating a hearing system and a method for handling hearing systems, which allow to realize at least one of the possible advantages mentioned above.

Another object of the invention is to provide a hearing system, a hearing system fitting system, a method for operating a hearing system and a method for handling hearing systems, which allow to simplify hearing device logistics, in particular which reduce efforts in conjunction with shipping and handling hearing devices.

Another object of the invention is to provide a hearing system, a hearing system fitting system, a method for operating a hearing system and a method for handling hearing systems, which allow to speed up the hearing device fitting and/or sales process and in particular avoid delays (of the order of days or more) during the fitting and/or sales process.

Further objects emerge from the description and embodiments below.

At least one of these objects is at least partially achieved by apparatuses and methods according to the patent claims.

The hearing system comprises at least one hearing device, and said hearing device comprises an operability control unit and, operationally connectable thereto, a storage unit in which operability data are stored. Said operability control unit is structured and configured to either disable or not disable said hearing device from functioning as a hearing device in dependence of said operability data, and said hearing system comprises no means for modifying said operability data, more particularly comprises no means for modifying said operability data stored in said storage unit.

This way, the hearing system itself does not allow to make a transition from a deactivated state in which said operability control unit disables the hearing device from functioning as a hearing device to an activated state in which the hearing device is not disabled by said operability control unit from functioning as a hearing device or vice versa. But via said operability data, it is possible to determine (determine in the sense of controlling or choosing) that the hearing device shall be in said deactivated or in said activated state. If furthermore, a deactivated or activated hearing device is mentioned, this is only a shorthand for a hearing device disabled and not disabled, respectively, by said operability control unit from functioning as a hearing device.

More particularly, there is no provision to enable to modify said operability data (more particularly said operability data stored in said storage unit) using solely said hearing system. Or: Said operability data (more particularly said operability data stored in said storage unit) are unmodifyable/uneditable by means of solely any device of said hearing system or unmodifyable/uneditable from within said hearing system (without further means).

Said modifying in particular comprises any modification or editing of the operability data, in particular it also comprises deleting and replacing and overwriting.

Usually, it is intended to provide that said operability data are not modifyable by a hearing system user.

In one embodiment, said operability data are digital data.

In case the expression "hearing device functions as a hearing device" would appear to be not sufficiently clear, the following attempt of a definition could be used: A hearing device functions as a hearing device, when it receives input signals, processes these input signals or signals derived therefrom and outputs the processed signals or signals derived therefrom as signals to be perceived by a user of the hearing device. More particularly, wherein said signals to be perceived by said user are useful for said user.

Said disabling said hearing device from functioning as a hearing device can be accomplished in various way, e.g., by means of a gain reduction to a value so low that no useful output signal is generated by the hearing device, by interrupting the signal path between input converter and output converter, or by interrupting a clock signal for a processor of the hearing device, or by interrupting the power supply of one or more components of the hearing device, or otherwise.

In one embodiment which may be combined with one or more of the before-addressed embodiments, the hearing system comprises a signal generating unit structured and configured to present a first signal in case said hearing device is disabled from functioning as a hearing device by said operability control unit and another signal, different from said first signal, in case said hearing device is not disabled from functioning as a hearing device by said operability control unit.

This way, it is possible to detect, by perceiving a signal, whether or not the hearing device is deactivated.

Note that a signal is also presented when the hearing device is deactivated. I.e., the absence of said first signal is not by itself an indication that the hearing device is deactivated.

Note that said signal generating unit can, e.g., be comprised in said hearing device.

In one embodiment with said signal generating unit, said first signal and said other signal are predetermined signals.

In one embodiment with said signal generating unit which may be combined with one or more of the before-addressed embodiments, it is provided that said other signal is selected from more than one possible other signals. The selection of the actually presented other signal may depend, e.g., on functionalities available in the hearing device. E.g., a low-priced hearing device might present a beep, whereas a high-end hearing device might present present a voice saying "Your Phonak hearing device is activated". The high-end hearing device will differ from the low-priced hearing device in having several additional or improved functionalities, such as, e.g., a beamformer functionality and a particularly advanced feedback suppression functionality or the like.

In one embodiment with said signal generating unit which may be combined with one or more of the before-addressed embodiments, said signal generating unit is controlled by said operability control unit.

In one embodiment with said signal generating unit which may be combined with one or more of the before-addressed embodiments, said signal generating unit is operationally connected/connectable to said storage unit, and the selection of the presented signal depends on said operability data.

In one embodiment with said signal generating unit which may be combined with one or more of the before-addressed embodiments, whenever said first signal or said other signal is presented, it is indicative of whether or not the hearing device is disabled from functioning as a hearing device by said operability control unit.

In one embodiment with said signal generating unit which may be combined with one or more of the before-addressed embodiments, said signals are provided by said signal generating unit.

In one embodiment with said signal generating unit which may be combined with one or more of the before-addressed embodiments, said signals are generated by said signal generating unit.

Note that at least in case the signal generating unit needs (electrical) power in order to be able to present said first and said other signal, respectively, it will be possible to distinguish between the case that the hearing device has no or an empty power supply and the case that the hearing device is disabled from functioning as a hearing device by said operability control unit. In the first case, the first signal will not be presented, whereas in the second case, the first signal will be presented.

Note that it is possible that the signal generating unit does not need power (or at least no or no significant from a power supply) in order to be able to present said first and said other signal, respectively. This may be accomplished, e.g., by means of technologies which require only a static voltage providable by a capacitor, e.g., like an LCD (liquid crystal display); this even works when the power supply (battery) is temporarily removed.

In one embodiment with said signal generating unit which may be combined with one or more of the before-addressed embodiments, said signal generating unit is structured and configured to substantially permanently present said first signal and said other signal, respectively (when in the respective state). This way, it is possible that the hearing device (or another device of the hearing system) presents said first signal essentially as long as it is disabled, and said other signal essentially as long as it is not disabled by said operability control unit. This facilitates to distinguish between deactivated and activated hearing devices.

As an alternative thereto, it is possible to provide that said signal generating unit is structured and configured to present said first signal and said other signal, respectively, upon request. E.g., one can provide that the hearing system or, more particularly said hearing device, presents said first or said other signal upon receiving a request signal; the reception of said request signal can be accomplished somewhere in the hearing system, or more particularly in the hearing device.

Such a request signal can be, e.g., a switching-on of the hearing device, or the pressing of a button of the hearing system, or an electromagnetic signal received in a suitable detector comprised in the hearing device, possibly even energizing said detector and/or said signal generating unit. The latter could be based on well-known RFID (radio frequency identification) technologies.

In one embodiment with said signal generating unit which may be combined with one or more of the before-addressed embodiments, said first signal and said other signal comprise at least one of

- an optical signal;
- an emitted optical signal;
- a reflected optical signal, e.g., originating from an LCD;
- electromagnetic waves, in particular emitted electromagnetic waves or reflected electromagnetic waves;
- emitted light, e.g., emitted by an LED;
- radiofrequency waves, e.g., like in the above-mentioned RFID example;
- sound waves, e.g., beep sounds, speech sounds, ultrasonic signals;
- a haptic signal, e.g., a vibration of the hearing device, e.g., similar to what many mobile phones do;

in particular, said first signal and said other signal are at least one of the mentioned signals. Note that said first signal and said other signal can, in general, be of different nature, e.g., one is a beep, the other is emitted light.

In one embodiment with said signal generating unit which may be combined with one or more of the before-addressed embodiments, said first signal and said other signal are human-perceivable signals. E.g., visible light, acoustic sound waves, vibration or others could be used here.

Alternatively, non-human-perceivable signals could be used, such as RF signals (cf. also the RFID example above) and ultrasonic sound. In such a case, a converter or reader could be used for receiving the first or the other signal, and thereupon a human-perceivable signal could be presented; e.g., an ultrasonic sensor connected to a computer displaying, e.g., "disabled" or "not disabled" could be used.

In one embodiment which may be combined with one or more of the before-addressed embodiments, said operability control unit is structured and configured to enable and disable at least one technical feature of said hearing device in dependence of said operability data. Note that the being disabled or not of the hearing device from functioning as a hearing device is not considered a technical feature of the hearing device. Examples for said technical features are the provision of a beamformer, the provision of a particular feedback canceller, the provision of an increased number of hearing programs or the like, cf. also the example of the low-priced and the high-end hearing device above.

In one embodiment with said signal generating unit which may be combined with one or more of the before-addressed embodiments, said other signal is indicative of whether said at least one technical feature is enabled or disabled by said operability control unit. Accordingly, it is possible to provide, that by means of said other signal, it can be sensed which features are disabled or enabled.

In one embodiment which may be combined with one or more of the before-addressed embodiments, said storage unit is non-volatile memory. This way, the operability data will remain intact for a long time, even when the hearing device is not supplied with power.

The hearing system fitting system comprises a hearing system according to one of the embodiment above and, operationally connected to said hearing device, a fitting apparatus for adjusting sound processing parameters of said hearing device. Said fitting apparatus comprises a preferably non-volatile memory, wherein said fitting apparatus is structured and configured to modify said operability data (in particular those operability data stored in said preferably non-volatile memory of said fitting apparatus) and to create a data set comprising data indicative of modified operability data and store said data set in said preferably non-volatile memory of said fitting apparatus. The "modifying" here is to be understood in the way described further above.

The invention comprises hearing system fitting systems with features of corresponding hearing systems according to the invention, and vice versa.

The advantages of the hearing system fitting systems basically correspond to the advantages of corresponding hearing systems and vice versa.

The method for operating a hearing system comprises the step of a) providing a hearing system comprising at least one hearing device comprising an operability control unit and, operationally connected to said operability control unit, a storage unit in which operability data are stored, wherein said hearing system comprises no means for modifying said operability data;

and, in dependence of said operability data, either the step of b1) disabling, by means of said operability control unit, said hearing device from functioning as a hearing device;

or the step of b2) not carrying out step b1).

In one embodiment, step b2) is replaced by the step of enabling said hearing device to function as a hearing device; more particularly the step of enabling, by means of said operability control unit, said hearing device to function as a hearing device.

In one embodiment of the method which may be combined with the before-addressed embodiment, the method comprises the step of storing operability data in said storage unit.

In one embodiment of the method which may be combined with one or more of the before-addressed embodiments, the method comprises carrying out, in case step b1) is carried out, the step of c1) presenting, by means of said hearing device, a first signal;

and, in case step b1) is not carried out, the step of c2) presenting, by means of said hearing device, another signal, said other signal being different from said first signal.

In one embodiment of the method which may be combined with one or more of the before-addressed embodiments, the method comprises the step of d) enabling or disabling, by means of said operability control unit and in dependence of said operability data, at least one technical feature of said hearing device.

In one embodiment of the method with steps c1) and c2), respectively, which may be combined with one or more of the before-addressed embodiments, said other signal is indicative of whether said at least one technical feature is enabled or disabled by said operability control unit.

In one embodiment of the method which may be combined with one or more of the before-addressed embodiments, the method comprises the steps of k) providing a fitting apparatus for adjusting sound processing parameters of said hearing device, said fitting apparatus comprising a preferably non-volatile memory;

l) operationally connecting said fitting apparatus to said hearing device;

m) modifying, by means of said fitting apparatus, said operability data;

n) creating, by means of said fitting apparatus, a data set comprising data indicative of said modified operability data;

o) storing said data set in said preferably non-volatile memory.

In particular, said fitting apparatus is a fitting apparatus for adjusting sound processing parameters of said hearing device to the hearing needs and preferences of an individual. Typically, said fitting apparatus substantially is a computer system with an appropriate (fitting) software and some accessories such as an interface for providing a (wireless or wirebound) connection to a hearing device.

It is preferred in certain applications that said operability data stored in said storage unit or the access to these is designed such that these operability data are modifyable/editable only by means of an appropriately equipped or programmed fitting apparatus.

Due to the use of said fitting apparatus (as an activation control device), separate physical tokens such as a chip card or the like can be dispensed with; it can be sufficient to simply have the appropriate fitting software.

In one embodiment of the method, which may be combined with one or more of the before-addressed embodiments, the method comprises deactivating a formerly activated hearing device which was deactivated before it had been activated. It is possible to provide that the hearing device is activated and deactivated many times.

In one embodiment of the method with said data set, which may be combined with one or more of the before-addressed embodiments, said fitting apparatus is, at least during steps l) and m), local to said hearing system, in particular connected thereto by a LAN (local area network, such as Bluetooth, RS232, USB) connection (which can be wireless or wire-bound).

In one embodiment of the method with said data set, which may be combined with one or more of the before-addressed embodiments, said fitting apparatus is, at least during steps l) and m), located within same building as the hearing device.

In one embodiment of the method with said data set, which may be combined with one or more of the before-addressed embodiments, said fitting apparatus is, at least during steps l) and m), not connected via a WAN (wide-area network, e.g., the internet) to said hearing device.

Such embodiments provide an enhanced robustness as well as security in the handling of the disabling/non-disabling process. E.g., no online connection (such as to the hearing device manufacturer) is required during activating or deactivating a hearing device.

In one embodiment of the method with said data set, which may be combined with one or more of the before-addressed embodiments, instead of step o) or in addition thereto, said data set is stored in a non-volatile memory of said hearing system, in particular in a non-volatile memory of said hearing device.

In one embodiment of the method with step d) and said data set, which may be combined with one or more of the before-addressed embodiments, the method comprises the step of q) comprising data in said data set which are indicative of whether said at least one technical feature is enabled or disabled by means of said operability control unit.

In one embodiment of the method with said data set, which may be combined with one or more of the before-addressed embodiments, the method comprises the step of p) protecting said data set in said preferably non-volatile memory from unauthorized access, in particular from unauthorized modification and/or replacement.

In other words, a misuse protection is provided. Making said data set misuse-proof can be accomplished, e.g., by encryption and/or by using a checksum/hash with a secret secure checksum/hash generating algorithm, and/or by using authentication schemes between fitting system and hearing device, and/or any other applicable cryptographic method. It is possible to provide that these cryptographic methods depend on one or more serial numbers or on a universally unique identification (UUID) (of fitting system and/or hearing device and/or hearing system, in particular on a serial number or UUID of the individual hearing device.

In one embodiment of the method with said data set, which may be combined with one or more of the before-addressed embodiments, said data set is transmitted from said fitting apparatus to said hearing system or vice versa, in particular from said fitting apparatus to said hearing device or vice versa, and the method comprises protecting said data set during said transmission from unauthorized access. Such a misuse-protection can be accomplished, e.g., in the before-described ways.

In one embodiment of the method with said data set, which may be combined with one or more of the before-addressed embodiments, said data set is stored alternatively or additionally in a non-volatile memory of said hearing system, in particular in a non-volatile memory of said hearing device, and the method comprises protecting said data set in said non-volatile memory of said hearing system (or of said hearing device) from unauthorized access. Such a misuse-protection can be accomplished, e.g., in the before-described ways.

In one embodiment of the method with said data set, which may be combined with one or more of the before-addressed embodiments, said hearing device comprises a device identifier, and said method comprises the step of r) comprising data representative of said device identifier in said data set.

Such a device identifier can be identical with hearing system identifier, but usually will not be.

The invention comprises methods for operating a hearing system with features of corresponding hearing systems according to the invention, and vice versa.

The advantages of the methods for operating a hearing system basically correspond to the advantages of corresponding hearing systems and vice versa.

Considered under a second aspect, the invention comprises a method for handling hearing systems, wherein hearing systems each comprise at least one hearing device. Said method comprises the steps of A) providing a hearing device seller or fitter with a multitude of deactivated hearing devices, wherein a deactivated hearing device is disabled from functioning as a hearing device;

B) said hearing device seller or fitter cancelling said deactivation of said hearing device using an activation control device external to said hearing system;

C) said activation control device creating a data set comprising data indicative of whether or not said hearing device is deactivated.

A hearing device seller or fitter provides end users (hearing device users) with hearing systems. Usually, he also provides the "fitting", i.e. the adaptation of sound processing properties and usually also other properties of the hearing system to the individual needs and preferences of said hearing device user.

In one embodiment of said second aspect, said activation control device is structured and configured to effectively avoid that step B) is carried out without step C) being carried out.

It is possible to provide that said data set comprises data indicative of a device identifier of said hearing device (for identifying said specific hearing device) and/or data indicative of a seller identifier (for identifying said hearing device seller or fitter).

In one embodiment of said second aspect, which may be combined with one or more of the before-addressed embodiments, the method comprises the step of D) transmitting said data set to a distributor or manufacturer of said hearing device.

Usually, said distributor or manufacturer provides the hearing device seller or fitter with said hearing device; said distributor or manufacturer carries out step A).

In one embodiment of said second aspect with step D), which may be combined with one or more of the before-addressed embodiments, step D) is carried out in a timely unrelated fashion with respect to steps B) and C). This can simplify the process and/or make the process more reliable.

E.g., no active communication connection from the hearing device seller or fitter to the distributor or manufacturer is required during step B) or step C); and more particularly, neither during fitting the hearing system (see below). And if said activation control device is integrated in a fitting apparatus: additional pieces of hardware (such as a separate data carrier like a chip card) can be dispensed with.

It can be advantageous to provide that said data set comprises data concerning more than one hearing devices and more than one hearing systems.

In one embodiment of said second aspect with step D), which may be combined with one or more of the before-addressed embodiments, the method comprises the step of E) carrying out a validity check of said data set after having properly received said data set.

Said validity check can be considered an integrity check; it is a check for finding out whether or not said data set has been manipulated or has undergone an unauthorized modification or is a correctly created data set. This can be done for avoiding misuse.

Typically, step E) is carried out by said distributor or manufacturer; possibly after having verified that the transmission of the data set was successful.

In one embodiment of said second aspect with step D), which may be combined with one or more of the before-addressed embodiments, the method comprises the step of H) creating an invoice upon receiving said data set.

In particular, the contents of said invoice, more particular, the amount of invoiced money, depends on the contents of said data set.

In one embodiment of said second aspect with step D), which may be combined with one or more of the before-addressed embodiments, the method comprises the step of I) providing said hearing device seller or fitter with one or more additional deactivated hearing devices upon receiving said data set.

In particular, the amount and/or kind of provided additional deactivated hearing devices depends on the contents of said data set.

In one embodiment of said second aspect which may be combined with one or more of the before-addressed embodiments, said activation control device is or comprises or is comprised in a fitting apparatus for adjusting sound processing parameters of said hearing device.

In a particular embodiment of this embodiment, the method comprises the step of

F) carrying out a validity check of said data set by means of said fitting apparatus;

G) creating an error message and/or disabling one or more functions of said fitting apparatus when the result of said validity check is indicative of lacking validity of said data set.

This allows to avoid misuse.

In one embodiment of said second aspect which may be combined with one or more of the before-addressed embodiments, the method comprises activating a deactivated hearing device and exchanging a defect hearing device against said activated hearing device, and—optionally—forwarding said defect hearing device to a suitable repair service, e.g., to the hearing device distributor or hearing device manufacturer.

In one embodiment of said second aspect which may be combined with one or more of the before-addressed embodiments, the method comprises deactivating a formerly activated hearing device which was deactivated before it had been activated.

The invention comprises methods for handling hearing systems with features of corresponding hearing system or corresponding methods for operating a hearing system according to the invention, and vice versa.

The advantages of the methods for handling hearing systems basically correspond to the advantages of corresponding hearing systems and corresponding methods for operating a hearing system, respectively, and vice versa.

Further embodiments and advantages emerge from the dependent claims and the figures.

BRIEF DESCRIPTION OF THE DRAWINGS

Below, the invention is described in more detail by means of examples and the included drawing. The FIGURE shows:

FIG. 1 a schematic illustration of methods and apparatuses according to the invention.

The reference symbols used in the FIGURE and their meaning are summarized in the list of reference symbols. The described embodiments are meant as examples and shall not confine the invention.

DETAILED DESCRIPTION OF THE INVENTION

FIG. 1 shows a schematic illustration of methods and apparatuses according to the invention. Firstly, we shall concentrate on a hearing system 1 according to the invention, which is depicted using the dash-dotted rectangle in FIG. 1. Most importantly, hearing system 1 comprises a hearing device 2. In addition, hearing system 1 can comprise further devices such as hearing device 18 and remote control 19, all operationally interconnected.

Basic components of hearing device 2 are depicted in the dotted rectangle 28: an input transducer 13 such as a microphone, a signal processing unit 14 and an output transducer 15 such as a loudspeaker. Input transducer 13 outputs audio signals, e.g., derived from incoming sound waves, which are then (usually after analog-to-digital conversion—not shown in FIG. 1) processed in signal processing unit 14, and the so-derived processed audio signals are (usually after digital-to-analog conversion—not shown in FIG. 1) fed to output transducer 15 which generates signals to be perceived by a user of the hearing device 2 and the hearing system 1, respectively. In a storage unit 16 of hearing device 2, sound processing parameters are stored in dependence of which the sound processing in signal processing unit 14 is carried out. These parameters are adjustable so as to be able to adjust the hearing device 2 to the hearing needs and preferences of the hearing device user.

Hearing device 2 comprises an operability control unit 3, e.g., embodied in form of software running on a processor, and a storage unit 4 in which operability data 5 are stored. Preferably, storage unit 4 is non-volatile writable memory such as flash or EEPROM. Depending on said operability data 5, operability control unit 3 will disable or not disable hearing device 1 from functioning as a hearing device. This can be accomplished, e.g., as indicated by arrow 22, by influencing the above-described basic components or their interaction. E.g., the signal flow between input transducer 13 and output transducer 15 can be interrupted, or a clock signal required by signal processing unit 14 can be interrupted. Or the input signal amplification of hearing device 2 can be so strongly reduced that the hearing device user cannot perceive a useful signal anymore, or other sound processing parameters can be set to such values that no useful signal can be perceived by the hearing device user anymore. Furthermore, a user interface of the hearing device can be deactivated when deactivating the hearing device; this can minimize misuse via manupulations of the user interface.

E.g., when booting the hearing device, said operability data will be read, and in dependence of these, a specific bit (usually in volatile memory) will be set to either 0 or 1. If that specific bit is 0, the hearing device will be disabled/deactivated, e.g., in one of the before-mentioned manners; if that bit is 1, the hearing device will be functionable.

In a scenario we principally want to discuss, hearing device 2 is delivered to a hearing device seller or fitter in a deactivated state, i.e. with such operability data 5 in storage unit 4 that hearing device 2 will not function as a hearing device.

Neither can said operability data 5 be amended or overwritten by hearing device 2 nor by any other device 18, 19 of hearing system 1. Accordingly, an external activation control device is needed for amending these operability data 5 in order to make operability control unit 3 cancel the deactivation. Cancelling the deactivation and therefore also editing the operability data 5 in storage unit 4 shall be misuse-proof. In order to prevent unauthorized access to operability data 5, these data can, e.g., be encrypted, secured by a checksum/hash or the like. Operability data 5 shall be amendable only by means of dedicated activation control devices. A deactivated hearing device is, without a suitable activation control device, virtually worthless.

Such an activation control device can, e.g., be a fitting apparatus 7. Fitting apparatus 7 can be embodied as a computer system with a suitable fitting software 9, which is basically used for adjusting the hearing device 2 and hearing system 1 to the hearing needs and preferences of the hearing device user. The latter is symbolized by arrow 31. Fitting apparatus 7 and hearing system 1 are components of a hearing system fitting system 8 which is local with a hearing device seller or fitter, indicated by reference S.

As indicated by arrow 30, using the appropriate fitting software 9, storage unit 4 of hearing device 2 can be accessed, and more particularly, operability data 5 can be edited. Preferably, this is accomplished via a secure connection, e.g., using data encryption, authentication schemes, data packet identifiers, hashes, acknowledgement of successful transmission by the receiver back to the transmitter and/or other cryptographic methods for securing data connections.

Furthermore, by means of fitting software 9, a data set 12 will be created and stored in a storage unit 10 of fitting apparatus 7 when operability data 5 are edited, wherein data set 12 reflects the new/edited operability data 5 or the corresponding amendments, as indicated by 5'.

Preferably, also data set 12 is protected from unauthorized access, e.g., using a checksum/hash or the like. And preferably, the editing of operability data 5 in storage unit 4 is linked to the generation or editing of data set 12 and/or the storing of data set 12 in storage unit 10 in a misuse-prohibiting way, e.g., by the cryptographic methods mentioned above.

Data set 12 can also comprise a device identifier identifying hearing device 2 and also a seller identifier identifying the hearing device seller or fitter.

Furthermore, configuration data possibly stored in storage unit 4 may be reflected in storage unit 10. Such configuration data are descriptive of the configuration of hearing device 2, in particular in the sense of whether it is configured as a low-cost device, as a midrange device or as a high-end device and which functionalities are made accessible, respectively. E.g., operability control unit 3 can, in dependence of said configuration data, allow or disable the use of an advanced beamforming algorithm or other functionalities.

Data set 12 can either comprise data relating to a multitude of hearing devices; or alternatively for each hearing device, a separate data set 12 is provided. We shall assume the first case now. Data set 12 can be used for billing the hearing device seller or fitter, wherein the invoice and the correspondingly billed sum can depend on the number of activated hearing devices and on their respective configuration; this will correspond to the number and kind of sold hearing devices. It is interesting to note that no online connection from the hearing device seller or fitter to the hearing device manufacturer is required during an activation process, and also a separate physical token such as a chip card or the like can be dispensed with. This makes the method very simple and robust.

A transmission of data set 12 to the hearing device manufacturer can take place at virtually any time, fully unrelated to the date and time of sales and hearing device activation processes. E.g., it could be weekly during night hours. Preferably, a secure connection is used here, too (cf. reference 24). A communication server 11 can be used for the transmission. This makes the process very robust. Note that it is possible to provide that, whenever fitting apparatus 7 is operationally connected to communication server 11, it is possible to transfer data set 12 from storage unit 10 to communication server 11, and it is also possible to provide that communication server 11 is running most of the time; whereas the fitting software 9 usually runs only during short periods of time. Accordingly, fitting software 9 and fitting apparatus 7 do not need a communication connection to the hearing device manufacturer M while reading or writing said data set 12 (and in particular the operability data), and they neither have to be in a specific location during doing so; and independent of when or where data set 12 (and in particular the operability data) have been written into storage unit 10 by fitting software 9, communication server 11 can read these data from storage unit 10 and securely be transmit them (still at an independently later point in time) to the hearing device manufacturer M.

At the hearing device manufacturer's or distributor's location (cf. reference M), data set 12 is, after a successful reception, checked for its validity in order to assure that no unauthorized manipulation has taken place (cf. reference 25). Then, dependent on data set 12, in particular of what it discloses about accomplished hearing device activation processes and corresponding hearing device configurations, an invoice will be sent to the hearing device seller or fitter (cf. reference 21 and 26) or another appropriate party such as an insurer, and furthermore, further deactivated hearing devices will be sent to the hearing device seller or fitter (cf. references 20 and 27).

Accordingly, by means of the invention, it is readily possible to provide hearing device sellers or fitters with a consignment stock of deactivated hearing devices and nevertheless be able to properly and relatively simply and securely invoice the hearing device seller or fitter, wherein the (final) billing can take place some time after the actual sale to the hearing device user has taken place.

As indicated by 7*a*, it can be advisable to carry out a validity check of the data set 12 by means of the fitting software, e.g., upon start-up of the fitting software or when attempting to cancel a deactivation of a hearing device. E.g., if an unauthorized modification of data set 12 is detected, further activation processes or the use of the fitting software 9 could be blocked, and moreover, a corresponding report could be sent to the hearing device manufacturer, e.g., via communication server 11.

Since it could be hard to distinguish between a deactivated hearing device and a hearing device without a suitable battery, it is advisable to provide in the hearing system 1 or more particularly in the hearing device 2 a signal generating unit 6 which is capable of presenting at least two different signals, one in case the hearing device is deactivated and another one in case the hearing device is not deactivated. E.g., red and green light, respectively, could be emitted by a signal processing unit 6 comprising light emitting diodes (LED) in case the hearing device is deactivated and not deactivated, respectively. Or, upon approaching the hearing device by means of an RFID reader, the hearing device emits an RF signal indicative of whether it is deactivated or not. Many other kinds and combinations of signals and corresponding signal generating units 6 are possible.

Whereas in the state of the art, a hearing device user usually has to wait one or more days after a first visit at the hearing device fitter's office until the actual hearing device is delivered and can be fitted, the invention can allow to start the hearing device fitting virtually without delay, e.g., when the hearing device fitter has a consignment stock of hearing device which can be activated at the hearing device differ's office, e.g., using the anyway present hearing device fitting software.

Similarly, in warranty cases, it is possible to provide the hearing device user with a replacement hearing device virtually without delay; it is sufficient to activate a suitable anyway present deactivated hearing device, and the defect hearing device can be send to the manufacturer at a later time.

Note that it is possible to provide that an activated formerly deactivated hearing device can be deactivated again, typically using the same activation control device used for activating, e.g., fitting apparatus 7.

Aspects of the embodiments have been described in terms of functional units. As is readily understood, these functional units may be realized in virtually any number of hardware and/or software components adapted to performing the specified functions. For example, storage unit 4 can be realized in one or more memory chips; and the storage unit 16 can be identical with storage unit 4, such that it contains not only sound parameters but also the operability data 5; and the signal generating unit 6 can be realized using signal processor 14 and output transducer 15; and so on.

LIST OF REFERENCE SYMBOLS

1 hearing system
2 hearing device
3 operability control unit
4 storage unit
5 operability data
6 signal generating unit
7 fitting apparatus
8 hearing system fitting system
9 fitting software
10 storage unit, non-volatile memory
11 communication server
12 data set
13 input transducer, microphone
14 signal processor, digital signal processor
15 output transducer, loudspeaker
16 storage unit
18 hearing device
19 remote control

What is claimed is:

1. A hearing system comprising:
at least one hearing device;
an operability control unit in the hearing device;
a storage unit operationally connected to the operability control unit;
operability data indicating whether the hearing device is in an activated state or in a deactivated state, said operability data being stored in said storage unit, wherein said operability control unit is structured and configured to either disable or not disable said hearing device from functioning as a hearing device in dependence of said operability data, wherein said hearing system comprises no means for modifying said operability data;
a signal generating unit structured and configured to present a first signal in case said hearing device is disabled from functioning as a hearing device by said operability control unit and another signal, different from said first signal, in case said hearing device is not disabled from functioning as a hearing device by said operability control unit, and
a fitting apparatus operationally connected to said hearing device, for adjusting sound processing parameters of said hearing device and having a memory, wherein said fitting apparatus is structured and configured to modify said operability data, to create a data set comprising data indicative of modified operability data, to store said data set in said memory, and to transmit the data set to a distributor or manufacturer of the hearing device, said data set indicating whether the hearing device is deactivated.

2. The hearing system according to claim 1, wherein said signal generating unit is structured and configured to substantially permanently present said first signal and said other signal, respectively.

3. The hearing system according to claim 1, wherein said signal generating unit is structured and configured to present said first signal and said other signal, respectively, upon request.

4. The hearing system according to claim 1, wherein said first signal and said other signal comprise at least one of
an optical signal, in particular an emitted optical signal or a reflected optical signal;
electromagnetic waves, in particular emitted electromagnetic waves or reflected electromagnetic waves;
emitted light;
radiofrequency waves;
sound waves; and
a haptic signal.

5. The hearing system according to claim 1, wherein said first signal and said other signal are human perceivable signals.

6. The hearing system according to claim 1, wherein said operability control unit is structured and configured to enable and disable at least one technical feature of said hearing device depending on said operability data.

7. The hearing system according to claim 1, wherein said operability control unit is structured and configured to enable and disable at least one technical feature of said hearing device depending on said operability data, and said other signal is indicative of whether said at least one technical feature is enabled or disabled by said operability control unit.

8. The hearing system according to claim 1, wherein said storage unit is a non-volatile memory.

9. A method for operating a hearing system, comprising steps of
a) providing a hearing system comprising at least one hearing device that comprises an operability control unit and, operationally connected to said operability control unit, a storage unit in which operability data indicating whether the hearing device is in an activated state or in a deactivated state are stored, wherein said hearing system comprises no means for modifying said operability data;
depending on said operability data, either the step of:
b1) disabling, by means of said operability control unit, said hearing device from functioning as a hearing device; or the step of
b2) enabling, by means of said operability control unit, said hearing device to function as a hearing device, and c) operationally connecting a fitting apparatus to said hearing device, for adjusting sound processing parameters of said hearing device, said fitting apparatus having a memory and being structured and configured to modify said operability data, to create a data set comprising data indicative of modified operability data, to store said data set in said memory, and to transmit the data set to a distributor or manufacturer of the hearing device, said data set indicating whether the hearing device is deactivated.

10. The method according to claim 9, further comprising, in case step b1) is carried out, a step of c1) presenting, by means of said hearing device, a first signal;

or, in case step b1) is not carried out, a step of c2) presenting, by means of said hearing device, another signal, wherein said other signal is different from said first signal.

11. The method according to claim 10, wherein depending on said operability data, said operability control unit either enables or disables at least one technical feature of said hearing device, and said other signal is indicative of whether said at least one technical feature is enabled or disabled by said operability control unit.

12. The method according to claim 9, further comprising a step of d) enabling or disabling, by means of said operability control unit depending on said operability data, at least one technical feature of said hearing device.

13. The method according to claim 9, further comprising steps of k) providing a fitting apparatus for adjusting sound processing parameters of said hearing device, wherein said fitting apparatus comprises a memory;

l) operationally connecting said fitting apparatus to said hearing device;

m) modifying, by means of said fitting apparatus, said operability data;

n) creating, by means of said fitting apparatus, a data set comprising data indicative of said modified operability data;

o) storing said data set in said memory.

14. The method according to claim 13, further comprising steps of d) enabling or disabling at least one technical feature of said hearing device via said operability control unit depending on said operability data;

q) creating a data set comprising data indicative of whether said at least one technical feature is enabled or disabled by said operability control unit.

15. The method according to claim 13, further comprising a step of:

p) protecting said data set in said memory from unauthorized access.

16. The method according to claim 13, wherein said hearing device comprises a device identifier, said method further comprising a step of r) comprising data representative of said device identifier in said data set.

17. A method for handling hearing systems, wherein said hearing systems each comprises at least one hearing device; said method comprising steps of:

A) providing a hearing device seller or fitter with a multitude of deactivated hearing devices, wherein each said deactivated hearing device is disabled from functioning as a hearing device, said hearing device comprising an operability control unit and, operationally connectable thereto, a storage unit, such as non-volatile memory, operability data being stored in said storage unit, and wherein said hearing device comprises no means for modifying said operability data;

B) said hearing device seller or fitter cancelling said deactivated state of said hearing device using an activation control device external to said hearing system by modifying said operability data;

C) said activation control device creating a data set comprising data indicative of whether or not said hearing device is deactivated.

18. The method according to claim 17, further comprising a step of:

D) transmitting said data set to a distributor or manufacturer of said hearing device.

19. The method according to claim 18, wherein step D) is carried out in a timely unrelated fashion with respect to steps B) and C).

20. The method according to claim 18, further comprising a step of:

E) carrying out a validity check on said data set after having properly received said data set.

21. The method according to claim 18, further comprising a step of:

I) providing said hearing device seller or fitter with one or more additional deactivated hearing devices upon receiving said data set.

22. The method according to claim 17, wherein said activation control device is or comprises or is comprised in a fitting apparatus for adjusting sound processing parameters of said hearing device.

23. A method for handling hearing systems, wherein said hearing systems each comprises at least one hearing device; said method comprising steps of:

A) providing a hearing device seller or fitter with a multitude of deactivated hearing devices, wherein each said deactivated hearing device is disabled from functioning as a hearing device;

B) said hearing device seller or fitter cancelling said deactivated state of said hearing device using an activation control device external to said hearing system;

C) said activation control device creating a data set comprising data indicative of whether or not said hearing device is deactivated;

D) transmitting said data set to a distributor or manufacturer of said hearing device; and H) creating an invoice upon receiving said data set.

24. A method for handling hearing systems, wherein said hearing systems each comprises at least one hearing device; said method comprising steps of:

A) providing a hearing device seller or fitter with a multitude of deactivated hearing devices, wherein each said deactivated hearing device is disabled from functioning as a hearing device;

B) said hearing device seller or fitter cancelling said deactivated state of said hearing device using an activation control device external to said hearing system;

C) said activation control device creating a data set comprising data indicative of whether or not said hearing device is deactivated, wherein said activation control device is or comprises or is comprised in a fitting apparatus for adjusting sound processing parameters of said hearing device;

F) carrying out a validity check of said data set by means of said fitting apparatus; and G) creating an error message and/or disabling one or more functions of said fitting apparatus when the result of said validity check indicating lacking validity of said data set.

* * * * *